US006412597B1

(12) United States Patent
Schola et al.

(10) Patent No.: US 6,412,597 B1
(45) Date of Patent: Jul. 2, 2002

(54) PLATE SUITABLE AS A NOISE PROTECTION WALL

(75) Inventors: Egbert Schola, Mullendorf (DE); Peter Seelmann, Dreistandegasse; Gerald Molnar, Gramatneusiedl, both of (AT)

(73) Assignee: Roehm GmbH & Co KG, Darmstadt (DE)

( * ) Notice: Subject to any disclaimer, the term of this patent is extended or adjusted under 35 U.S.C. 154(b) by 0 days.

(21) Appl. No.: 09/414,698

(22) Filed: Oct. 7, 1999

(30) Foreign Application Priority Data

Oct. 6, 1998 (DE) ..... 198 46 024

(51) Int. Cl.[7] ..... E04B 1/82
(52) U.S. Cl. ..... 181/290; 181/291; 181/294
(58) Field of Search ..... 181/290, 284, 181/294, 289, 291, 210, 211, 208, 287, 295, 30

(56) References Cited

U.S. PATENT DOCUMENTS 4,516,658 A * 5/1985 Scarton et al. ..... 181/208
4,832,147 A * 5/1989 Dear et al. ..... 181/30
5,154,953 A * 10/1992 De Moncuit et al. ..... 428/34
5,272,284 A * 12/1993 Schmanski ..... 181/210
5,411,623 A * 5/1995 Shutt ..... 156/290
5,532,440 A * 7/1996 Fujiwara ..... 181/289
5,550,338 A * 8/1996 Hielscher ..... 181/290
5,872,341 A * 2/1999 Nielsen ..... 181/210
5,907,932 A * 6/1999 LeConte et al. ..... 52/144
5,971,009 A * 10/1999 Yasuda et al. ..... 181/286

* cited by examiner

*Primary Examiner*—Robert E. Nappi
*Assistant Examiner*—Kim Lockett
(74) *Attorney, Agent, or Firm*—Oblon, Spivak, McClelland, Maier & Neustadt, P.C.

(57) ABSTRACT

A plate utilizable in a noise protection wall of fragile acrylic glass comprising a plurality of side by side synthetic monofilament plastic threads for embedded in and running along the plate for splinter binding on breakage of the glass wherein, at least one thread has a maximum deviation of 1 mm or more from a theoretical straight line connecting the ends of said thread.

7 Claims, 3 Drawing Sheets

PLATE SUITABLE AS A NOISE PROTECTION WALL

FIELD OF THE INVENTION

Plates suitable as noise protection elements made of basically frangible acrylic glass in which plastic monofilament threads are embedded to reduce splintering in the possible event of breakage of the glass.

DISCUSSION OF THE PRIOR ART

Plates of the prior art which are secured against the origination and falling down of loose fragments are known from EP 0 407 852. The plates disclosed therein contain, embedded therein, relative to the plate cross-section substantially essentially centrally located monofilament synthetic threads, or a web of such threads. Monofilament threads made of polyamide are particularly suitable as synthetic threads. In the above-mentioned EP 0 407 852 it is emphasized that the embedded synthetic threads are substantially invisible, so that the elements remain transparent. Furthermore, because the synthetic threads are embedded into the interior of the plate an optimal protection against weathering is provided. The cleaning of the plate is unproblematic. Furthermore, even at low temperatures, i.e below −20° C., they are still secured against the occurrence and dropping of loose fragments. Nevertheless, it must be stressed that the central location substantially increases the production cost of such plates.

In accordance with EP 0 826 832 break resistant noise protection plates of acrylic polymers are known which contain synthetic filaments wherein the filaments are not centrally located. Rather the filaments are located in a spacing of between 20 and 35% of the total thickness of the plate relative to their surface with respect to that surface which is exposed in a possible crash. In accordance with the disclosure of EP 0 826 832 it is, also possible to obtain breakage secured noise protecting elements even with the non-central location. However, it remains to be determined whether the test methods utilized to substantiate this alleged effect are sufficient, since the utilized impact energies lie in an insufficiently high area. In contrast thereto, an element in accordance with EP 0 407 852 withstands a test under din 52 250, that is to say, a corresponding plate which is free on both sides is shattered by a steel ball of mass 4.1 kilograms dropped from a height of 9 meters, but nevertheless, produces no free fragments. It is especially to be noted that all thus originating fragments are held together by the embedded threads.

SUMMARY OF THE INVENTION

In accordance with the present invention, it has been unexpectedly and surprisingly found that it is possible to obtain shatter protection and noise protection by means of plates of the prior art wherein at least one of the embedded threads has a maximum deviation of 1 mm or more from a straight line drawn between the ends of these plates.

This, so to speak sagging "positioning" of the threads in the acrylic glass matrix leads, under certain circumstances, to an advantageous behavior of the plates of the present invention utilized as sound protection walls in the appropriate tests. For example, in accordance with ZTV-LSW 88 under 3.4.2 and under the guideline LS3 of the German Federal Ministry for Traffic "Additional technical rules and guidelines for the implementation of sound protection walls on streets". The term "maximum deviation" in sense of the invention is the largest spacing of the threads from the theoretical line drawn between the ends of said threads. In the preferred embodiment it is provided that this maximum deviation is 3 mm or more. It is even more desirable if the maximum deviation in accordance with the plate of the present invention is 5 mm or more.

This maximum deviation however, must not lead thereto that the threads lie outside the plate, rather it must always be guaranteed in the scope of the invention that the synthetic threads are actually embedded. The maximum deviation which can also be more simply described as the bending of the synthetic threads can, therefore, never be greater than the plate thickness less the thread diameter.

The deviation of the synthetic threads in accordance with the present invention can be perpendicular to the plane of the plate. Such an orientation of the embedded threads can be achieved thereby that the threads are embedded under the influence of gravity after the acrylic glass forming mass is poured in a "lying chamber" procedure.

Alternatively to this procedure, there is another preferred embodiment wherein the deviation of the plastic threads is substantially parallel to the thread plane. Such an arrangement of the thread orientation is readily given thereby that the plate is poured in the so called Rostero procedure. In substantially vertically standing chambers as is common in this procedure, the threads bend or hang under the influence of gravity parallel to the plane of the plate.

Yet another useful procedure for preparing the plates in accordance with the present invention is one wherein the threads sag substantially perpendicular to the plate plane and the plate contains the threads whose deviation is substantially parallel to the thread plane. Such an arrangement of the securing threads is obtained thereby wherein two threads of different lengths are utilized and thus, one of the threads is substantially parallel to the glass surface and the other thread has a deviation relative to the plate plane.

It is also possible to glue together a pair of 15 mm plates with vertical or parallel deviation to the surface to provide a 30 mm plate and thus, to obtain one within the scope of the present invention.

A particular case exists when rolled embedded polyamide threads are utilized. These give rise to a particularly useful breaking behavior. It is meaningful to utilize transparent polyamide threads, since otherwise the transparency of the plate is sharply reduced.

According to the selected procedure and production of the plates in accordance with the present invention it is thus possible to provide virtually any desired orientation of the synthetic threads in the polymer matrix.

Thus, next to a perpendicular or parallel arrangement relative to the plate plane it is also possible to achieve a deviation which lies in a free gradation between these two limit values.

In accordance with the present invention, the threads can run substantially perpendicular to a surface of a plate.

Furthermore, this invention makes it possible to embed threads in the polymer matrix which do not run parallel to a surface but, for example, are embedded transverse thereto.

This means with a view to the first variant, in a particularly desirable embodiment each of the thread ends of at least one thread subtend substantially the same separation from a surface of the thread plane and/or to one of the edges of the plate. With respect to the previously specified condition, the threads are embedded substantially parallel to a surface of the plate plane and/or to one of the edges of the plate.

Alternatively with respect to the second variant there are also preferred embodiments wherein the distance of the thread ends of at least one thread to a surface in the plate plane and/or an edge of the plate are different. Particularly from the last named circumstance it follows that the creation of a sound barrier element in accordance with the present invention, is substantially simpler relative to the formation of an element in accordance with the state of art, since substantially higher tolerances may be taken into account, in fact may be desired without suffering any disadvantages with respect to a breakage condition.

Basically seen the embedded synthetic threads can be so oriented that they are parallel to each other in only one direction, or so that they run parallel to each other in two or more directions. Herein in the last named case, it is possible among other things that the two directions form a mutual angle of 90° or also an angle of less than 90°.

As plastic threads, monofilament threads of polyamide or polypropylene are particularly suitable because of their adhesibility to the surrounding acrylic glass is relatively small and therefore at substantially reduced temperature there is no noticeable loss in the tear resistance. At the breaking of the acrylic glass, the monofilament synthetic threads can stretch and therefore, do not rip or in any event do so minimally and therefore hold the thus produced fragments together. The diameter of the monofilament threads may usefully lie between 0.2 and 2 mm. The sidewards distance between neighboring threads can lie between 8 and 100 mm. However, separations greater or less than this are possible.

In addition, at least a part of the threads or if desired all of the threads, may be colored to give contrast. For example, this coloring may be black for the formation of the sound protecting elements this always serves to protect the elements from birds.

Plates in accordance with the invention are made with acrylic glass and can be produced by one skilled in the art from generally speaking known materials. Thus, preferably the plates are poured from methylmethacrylate syrup. The size of the plates varies in the range of 1 m by 2 m to 2 m by 3 m, or even larger. The thickness of the plates lies in the range of 5 to 30 mm, suitably 12 to 25 mm, most desirably 15 to 20 mm. The plates in accordance with the present invention may be characterized by a series of particularly advantageous properties.

The plates in accordance with the present invention show very good splinter binding properties in particular, at higher destruction spends or lower temperatures. It is particularly advantageous to provide a deviation of the threads of more than 3 mm, a displacement arrangement of the thread ends or a double layered arrangement of the polyamide threads, or a net type hang through arrangement of the safety threads.

The thus described plates are especially suitable for use as sound protection plates in the railroad or rapid transit area, since here particularly high destruction speeds can occur. A further advantage of the plates of the present invention resides therein with one sided installation. The strongly sagging bi-layered or sagging networks exhibit an excellent cohesion in contrast to centrally centered polyamide threads oriented parallel to the surface of the plate. In accordance with the present invention, the present invention may be illustrated by means of the drawings as follows:

DETAILED DESCRIPTION OF THE DRAWINGS

Figure 1:
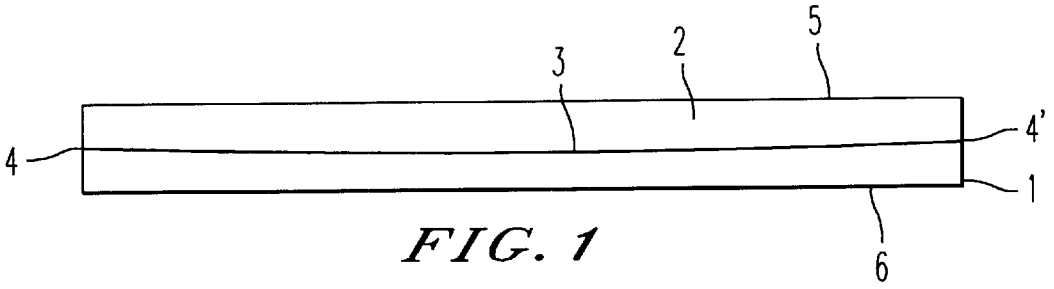
FIG. 1 is a cross-sectional view of a sound protection element having a thread orientation in accordance with the first embodiment of the present invention.

In FIG. 1 the item number 1 signifies a plate of acrylic glass with embedded synthetic threads. Item number 2 indicates a polymer matrix, whereas item number 3 indicates a polyamide thread. The thread ends are designated 4 and 4'. The distance of the thread beginning and the thread end to the surface 5 is equally large as is the distance of the thread end beginning to surface 6. It will be recognized that the thread 3 halfway between the thread beginning 4 and the thread end 4' has a maximum deviation, that is to say, a deviation from a theoretical line joining 4 and 4'.

Figure 2:
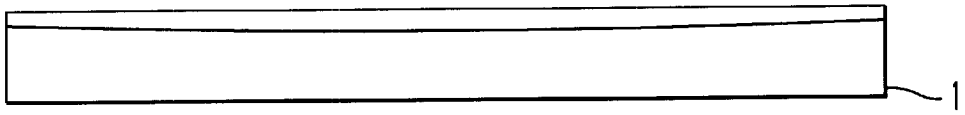
FIG. 2 is a cross-sectional view in accordance with a second embodiment.

In FIG. 2 there is shown a further embodiment wherein while there is an equal distance between thread ends 4 and 4' to the surface 5 and similarly with respect to surface 6 the actual separations of said thread ends from surfaces 5 and 6 are different from each other. This indicates that the illustrated threads are not hung centrally. That is to say, not symmetrically rather the shown threads are embedded asymmetrically.

Figure 3:
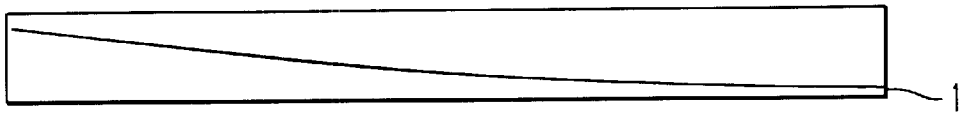
FIG. 3 is a cross-sectional view in accordance with the third embodiment.

In the embodiment illustrated in FIG. 3, we are dealing with a thread embedded diagonally in the polymer matrix.

Here in particular the condition is fulfilled that the separation of thread ends 4 and 4' is different with respect to surfaces 5 and 6.

Figure 4A:
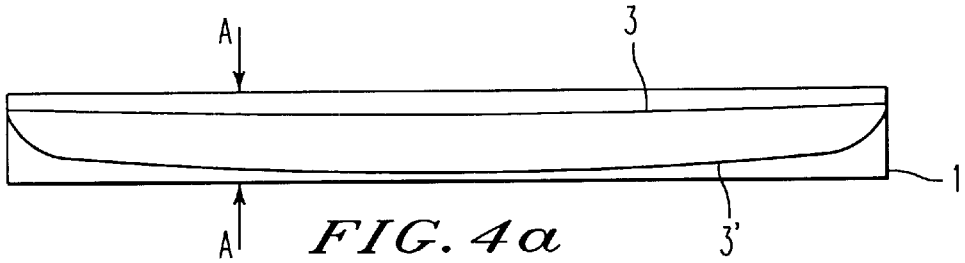
FIG. 4A is a cross-section through a sound protection element in accordance with the fourth embodiment of the present invention comprising a pair of threads of different lengths deviating vertically from one surface oriented substantially side by side to each other.
Figure 4B:
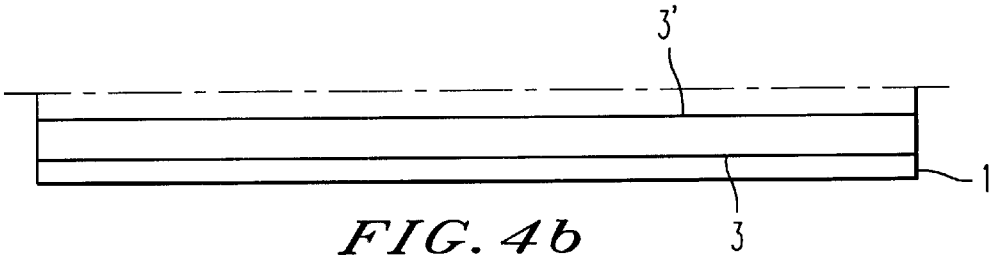
FIG. 4B is a cross-sectional view along line AA of FIG. 4A.

A further embodiment of the invention is illustrated in FIG. 4 whereby there are shown two embedded threads 3 and 3' which are oriented in an alternating manner that is to say, that 3' has a greater vertical deviation than 3. It will be understood that 3 and 3' actually represent a row of a plurality of threads in the plate. It is also clear that one of the threads has no or substantially no vertical deviation whereas, the second thread (3') is strongly deviated from the normal situation. FIG. 4*b* illustrates this situation more clearly with respect to the cross-section along line AA.

Figure 5A:
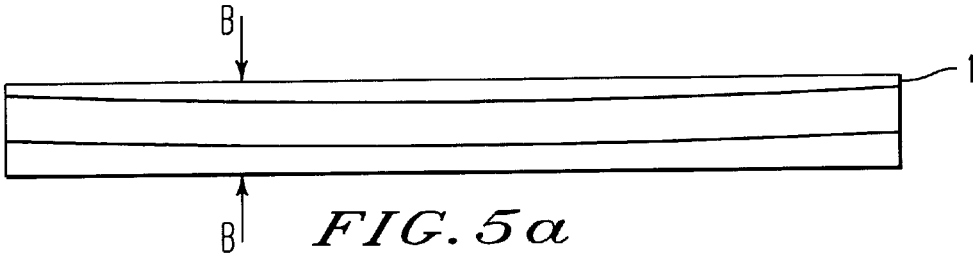
FIG. 5A is a cross-sectional view of a sound protection element in accordance with a fifth embodiment of the present invention showing two threads of substantially the same length substantially parallel to one surface oriented substantially in the same vertical plane.
Figure 5B:
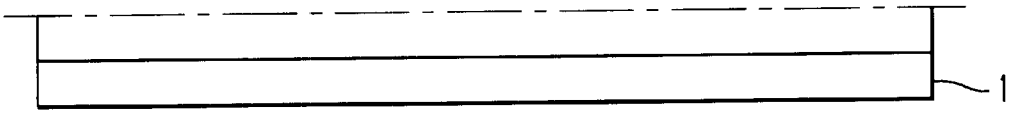
FIG. 5B is a cross-sectional view along line AA of FIG. 5A.

Still another variant of the noise protection elements in accordance with the present invention is shown in FIG. 5. Herein we are concerned with a multiple layering of threads over each other. These can hang directly over each other, however there are embodiments where the multiple threads are displaced sidewards from each other, see line BB in FIG. 5*a*.

Figure 6A:
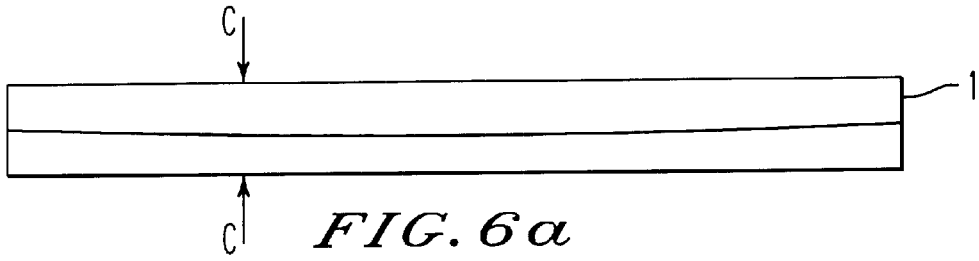
FIG. 6A is a cross-sectional view of a sound protection element in accordance with the sixth embodiment of the present invention showing a network lying in one plane parallel to one surface of the element.
Figure 6B:
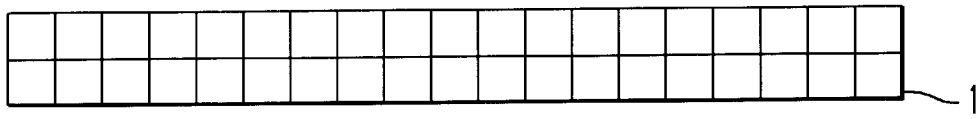
FIG. 6B is a cross-sectional view along line AA of FIG. 6A showing a plan view of the network.

Similarly as shown in FIGS. 4*a* and *b* and FIGS. 5*a* and *b,* FIG. 6 shows not only the cross-section, but also in plan a further arrangement in accordance with the present invention. The illustrations of FIGS. 6*a* and 6*b* make clear that the hanging threads can also be oriented in a net form. See FIG. 6*a* line C—C.

Figure 7:
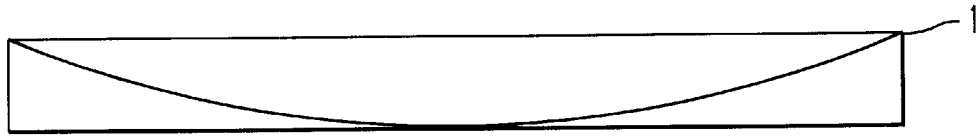
FIG. 7 is a cross-sectional view of a sound protecting element in accordance with the seventh embodiment of the present invention showing a thread attached substantially to the outer edges of the plate at one surface and looped down to substantially the depth of the plate.

FIG. 7 shows a further embodiment having maximum bending of the threads. This shows maximally the plate thickness reduced by the thickness of threads.

Figure 8:
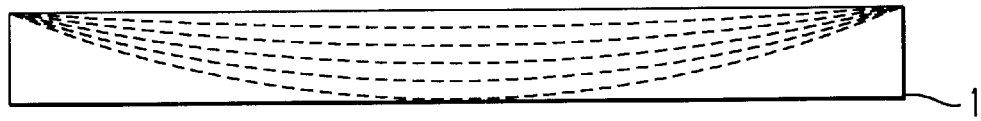
FIG. 8 is a cross-section of a sound protecting element in accordance with the eight embodiment of the present invention showing, similar to the cross-section of FIG. 7 a plurality of threads attached to the outer edges of a plate close to one surface and looped downwardly in various spacings from slightly below the top surface to slightly below the bottom surface.

Another embodiment i s to be found in the illustration of FIG. 8. Here there is shown a cross-section through the embodiment in which the sagging of the threads varies at a plate thickness of 20 mm from a sag of 1 mm in the most tensioned thread to 19 m in the thread with maximum sagging.

Figure 9:
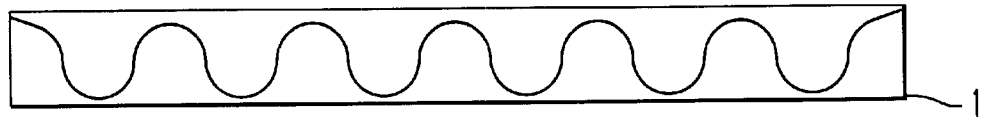
FIG. 9 is a cross-sectional view of a sound protecting element of the present invention showing a thread oriented in substantially sinusoidal form.

Finally in FIG. 9 there is yet another arrangement within the scope of the present invention shown in cross-section where there is a sinusoidal orientation of the threads.

Figure 10:
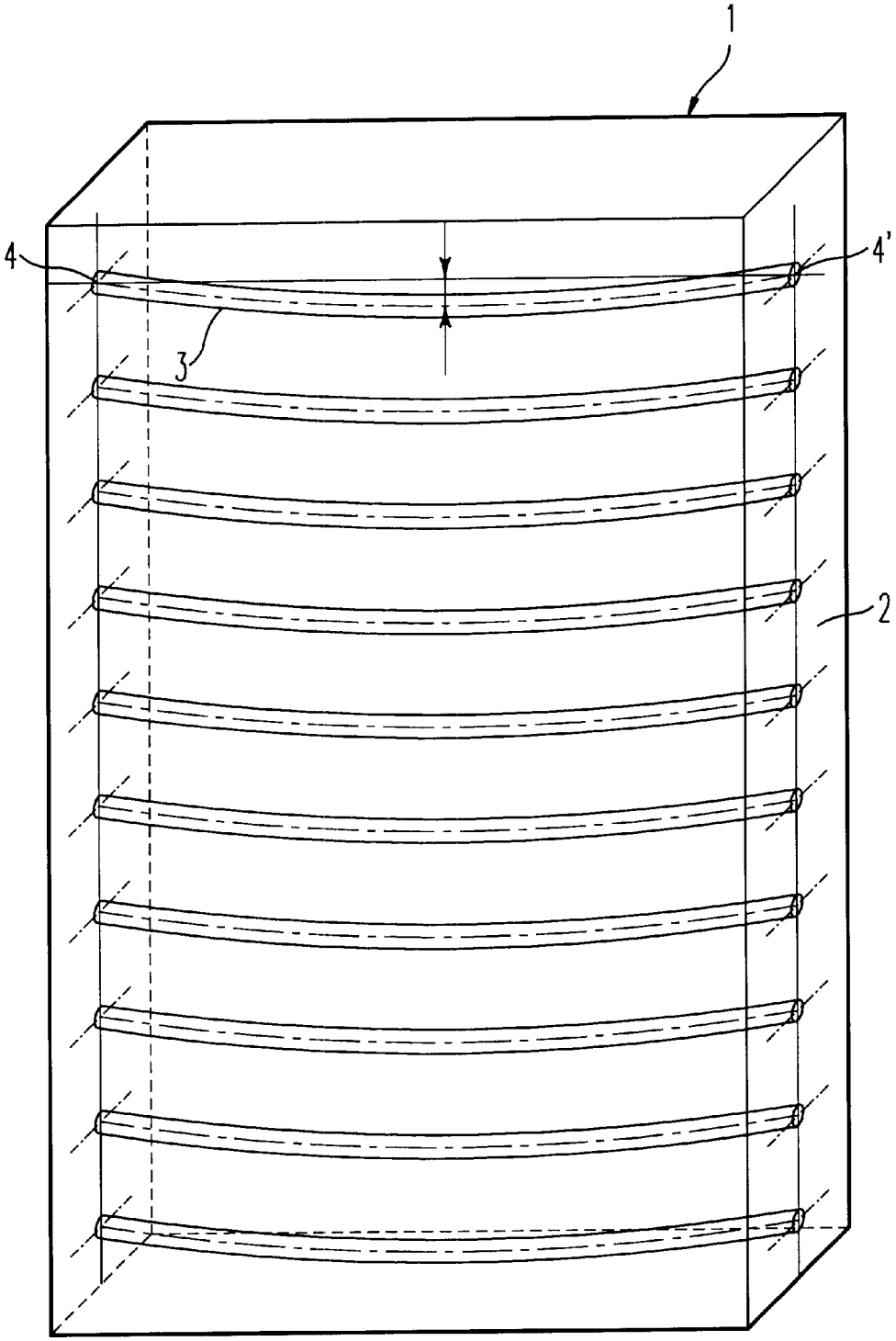
FIG. 10 is a downward prospective view of a plate in accordance with the present invention produced in accordance with the Rostero process showing a plurality of embedded threads in a substantially vertical plane deviating downwardly with respect to one edge of the plate.

Finally FIG. 10 shows an embodiment in which the arrangement of the embedded synthetic threads is so shown that they have a sag or maximum deviation which is parallel to the plate plane as already shown, such a thread can readily be obtained in the Roster process.

EXAMPLES

Example 1

In order to produce an acrylic, glass plate in accordance with FIG. 1 a chamber is formed out of two polished silicate glass plates of dimension 2 meters by 3 meters separated by a space of 20 mm. Into this Chamber with a separation of 30 mm there were provided parallel to each other monofilpolyamide threads having a diameter of 2 mm. These polyamide threads were so provided that they each had a sag of 2 mm. Thereafter, the chamber was filled with methylmethacrylate syrup which contained a radial forming initiator and capped. The filled chamber was placed in a water bath and by means of warming the syrup was cross-linked to a high molecular polymethylmethacrylate. The chamber was polymerized lying down so that the sagging of the threads was perpendicular to the main plane of the polymethylmethacrylate. After removal of the forms there was given a cast acrylic glass plate 2 meters by 3 meters in size and 20 mm thick with embedded polyamide threads. The positioning of polyamide threads and the thread sagging was measured by an ultrasound echometer (10 $MH_2$ measuring frequency). The measuring head of the echo device is equipped with a sender and a receiver, so that the separation between the PMMA surface and the polyamide threads can be measured. In the middle of the plate a maximum sag of 4 mm was measured. The thus obtained plate was subjected to a pendulum test. In principle, in this test a steel pear shaped impactor 400 kg in weight was lifted to a height of 1.6 meters and thus utilized destroyed the plate. The review criterion requires there should not be free fragments greater than 25 centimeters square and having an angle greater than 15°.

Carrying out of the pendulum test:

In the first variation corresponding to DIN norm test, it is desired that a three-sided secured plate is tested. For this purpose the lower edge on which the plate stands, as well as, the two left and right edges of the plate are secured to a steel frame. The plate is then set up perpendicular whereby the upper edge of the plate is not tensioned. In this procedure the two corners of the glass plate comprise holes through which an additional cord is passed which is secured to the frame structure. Against such a secured plate the pendulum test is carried out, that is to say a free swinging pendulum comprising a pear shaped impactor strikes the plate relatively, centrally.

The 2 meter by 3 meter plates where built into a 3 sided steel frame construction. In each corner of the plate there is provided at a distance of about 15 cm's a hole for the reception of a catch protecting means, that is to say, a steel rope is utilized that is pulled through the four holes of the acrylic glass plate and attached from the frame construction. This construction corresponds to the normal mounting of a transparent noise protecting wall. The separation of the acrylic glass plate to the energy consumption wall is 1.24 meters. In the normal circumstances the pear smashes through the acrylic glass plate and is braked by the wooden wall.

In a variant of this procedure there is a one sided tensioning of the plate at the lower edge. The plate is only attached at the lower edge, three edges of the plate that is to say, the upper edge, the left and the right edges remain free. Heretofore, there is no official DIN procedure however, there is the thought of building corresponding walls. In this case, with the wall only secured at one edge the test pendulum is directed so that it is strikes relatively centrally (i. e. a steel pear shaped impactor) which is intended to simulate a variation of an automobile crash therewith.

The acrylic glass sheet is destroyed by the pear which drops onto the plate from a height of 1.6 meters. The pear consists of a pair of welded ball stumps. The impact speed amounted to 5.6 meters per second the energy 6.78 joules. The measurement took place at 20° C. as well as −20° C. In both cases there were no free fragments. For the break results it is insignificant whether the thread deviation is in the direction of the destroying body, or turned away from it.

Example 2

For the formation of a system element:

In accordance with FIG. 2 a chamber of 20 mm thickness was built in a Rostero oven. Into this chamber polyamide cords separated by 30 mm were laid which were parallel to the surface and had a deviation of 5 mm. The diameter of the polyamide strings utilized was 2 mm. The thus obtained chamber was filled with methylmethacrylate syrup containing a radical forming initiator. After filling the chamber was evacuated and heated to 50° C. to start the polymerization. Because of the vertical orientation of the polymerization chamber the polyamide strings hung parallel to the surface.

After complete hardening of the plate this was removed from the form and subjected to the breaking test. Whether carried out at −20° C. or +20° C. no free fragments were noted.

Example 3

The procedure was carried out in accordance with Example 1 with the difference that in place of monofilament polyamide threads a polyamide grid of monofilament threads having a diameter of 2 mm and a stitch width of 50 ×50 mm were installed with a maximum sag of 8 mm. These plates had a thickness of 20 mm and were subjected to the pendulum test. The difference was that the plate was not built up three-sided by only single-sided. In the pendulum test carried out at 20° C. there were no free broken pieces.

Example 4

The procedure test was carried out in accordance with Example 1. The pendulum test was run from 8 meters, the impact speed was 12.53 meters per second, the energy 31.392 joules. There were no free fragments at 20° C. With respect to the breaking result it is irrelevant whether the thread deviation is in the direction of destroying body, or turned away therefrom.

What is claimed is:

1. A plate utilizable in a noise protection wall comprising:

a plurality of side by side synthetic monofilament plastic threads embedded in and running through the plate from ends of the plate;

wherein at least one of said plurality of side by side synthetic monofilament plastic threads has a maximum deviation of 1 mm or more from a straight line connecting ends of said at least one thread at points at which said at least one thread is embedded in the plate.

2. A plate in accordance with claim 1, wherein the maximum deviation is at least 3 mm.

3. A plate in accordance with claim 1, wherein the maximum deviation is at least 5 mm.

4. A plate in accordance with claim 1, wherein the deviation is substantially parallel to a surface of the plate.

5. A plate in accordance with claim 1, wherein at least a first portion of said plurality of side by side synthetic monofilament plastic threads have a deviation substantially perpendicular to a plane of a surface of the plate and at least a second portion of said plurality of side by side synthetic monofilament threads have a deviation substantially parallel to the plate surface.

6. A plate in accordance with claim 1, wherein said at least one thread is embedded diagonally.

7. A plate in accordance with claim 1, wherein said at least one thread includes plural threads with increasing deviations.

* * * * *